US008807332B1

(12) United States Patent
Pascua et al.

(10) Patent No.: US 8,807,332 B1
(45) Date of Patent: Aug. 19, 2014

(54) FINANCIAL TRANSACTION CARD PACKAGING HAVING INTERNAL PANEL FOR TAMPER PREVENTION

(75) Inventors: Shelle B. Pascua, Sherwood, OR (US); Michael Gallegos, Portland, OR (US)

(73) Assignee: Travel Tags, Inc., North Mankato, MN (US)

( * ) Notice: Subject to any disclaimer, the term of this patent is extended or adjusted under 35 U.S.C. 154(b) by 491 days.

(21) Appl. No.: 12/609,753

(22) Filed: Oct. 30, 2009

(51) Int. Cl.
*A45C 11/18* (2006.01)

(52) U.S. Cl.
USPC ..... 206/39; 206/449

(58) Field of Classification Search
USPC ..... 206/449, 461, 471, 232, 454, 307, 39, 206/39.5, 39.6, 39.7, 450, 37, 555, 784, 206/525.1, 750; 283/62; 40/124.12, 124.04, 40/124.06, 405; 229/87.5
See application file for complete search history.

(56) References Cited

U.S. PATENT DOCUMENTS

| | | | | |
|---|---|---|---|---|
| 1,106,058 | A * | 8/1914 | Rand | 229/92.8 |
| 1,539,619 | A * | 5/1925 | Wood | 40/778 |
| 4,034,210 | A | 7/1977 | Hill et al. | |
| 5,275,285 | A * | 1/1994 | Clegg | 206/449 |
| 5,337,949 | A * | 8/1994 | Seeley | 229/92.8 |
| 5,746,689 | A * | 5/1998 | Murphy | 493/397 |
| 6,349,829 | B1 * | 2/2002 | Matheis et al. | 206/449 |
| 6,715,795 | B2 | 4/2004 | Klure | |
| 6,732,459 | B1 * | 5/2004 | Clark | 40/124.06 |
| 6,978,562 | B2 * | 12/2005 | Frenkel | 40/124.06 |
| 7,954,721 | B2 * | 6/2011 | Anderson et al. | 235/487 |
| 2002/0100797 | A1 * | 8/2002 | Hollingsworth et al. | 229/92.8 |
| 2007/0063052 | A1 * | 3/2007 | Chakiris et al. | 235/486 |
| 2008/0116089 | A1 | 5/2008 | Roberts | |
| 2009/0091123 | A1 * | 4/2009 | Conley et al. | 283/106 |

* cited by examiner

*Primary Examiner* — Jacob K Ackun
*Assistant Examiner* — Jenine Pagan
(74) *Attorney, Agent, or Firm* — Dicke, Billig & Czaja, PLLC.

(57) ABSTRACT

A financial transaction card is packaged by a carrier which contains the card and restricts motion of the card sufficiently to inhibit removal of the card by improper means (e.g., creating a slit in the exterior of the package and sliding the card out) prior to activation of the financial transaction account associated with the card at the point of sale. In a preferred embodiment, the package is a simple three-panel construction having an internal panel provided with slits that do not contact the card unless improper removal of the card is attempted. Such a feature provides substantial security for the packaged card, at minimal manufacturing cost.

7 Claims, 9 Drawing Sheets

FINANCIAL TRANSACTION CARD PACKAGING HAVING INTERNAL PANEL FOR TAMPER PREVENTION

TECHNICAL FIELD

This application involves packaging for financial transaction cards, particularly packaging that maintains the security of the card prior to activation of the financial transaction account associated with the card at the point of sale, such as commercial or retail store locations or kiosks.

BACKGROUND

Financial transaction cards (or, for this application, simply "cards") may be credit cards, stored value cards (also known as gift cards, prepaid cards, shopping cards, loyalty or reward cards, and so on) or other objects which function similarly (e.g., an object bearing a barcode, magnetic stripe, RFID chip or other feature recognizable at the point of sale to activate a financial account or subsequently perform or track a transaction). Commonly shaped and sized "cards" have the form factor known as CR80, but CR50, CR79, CR90, and CR200 form factors also are common. Other, non-standard shapes and sizes exist as well. Cards may include a magnetic stripe, barcode or other indicia for identification, data transfer, account activation, verification, or other purposes.

The cards may or may not have value associated with them, i.e., the value may be already in the account ("on the card") before purchase, or it may be initially added ("loaded") or subsequently added ("reloaded") at point of sale or through any other form of data transmission used for electronic commerce.

Cards are often contained within packaging to deter tampering with the card itself. Physical damage to the package provides evidence of attempts to access the card or remove it entirely. However, tamper-evident features present new problems, notably interference with other aspects of the packaging, and increased complexity and manufacturing cost.

SUMMARY OF THE DISCLOSURE

The transaction card packaging system of this application solves the problems described above, by including non-adhesive features wholly internal to the assembled package that inhibit or impair removal of the card from the package, such as by sliding the card out a slit in the package created by a thief.

Thus, in one aspect, a financial transaction card system comprises at least one financial transaction card mounted within a package having an internal panel immediately adjacent the card. The internal panel comprises at least one die cut, each die cut located outside the perimeter of the card, but between the perimeter of the card and the perimeter of the panel.

A package may be a folded carrier or an assembly of pieces attached (e.g., adhered or otherwise joined or affixed) together.

Still further aspects are included in the specific, but non-limiting, examples described below and depicted by way of illustration only in the accompanying drawings.

DETAILED DESCRIPTION

In the figures, a relatively thick solid line indicates a die or cut line; a relatively thin solid line indicates the outline or features of another object such as the financial transaction card; a thin dashed line indicates a perforated line; and a thin solid line indicates a score or fold line (or, "foldable [first, second, etc.] line").

Figure 6:
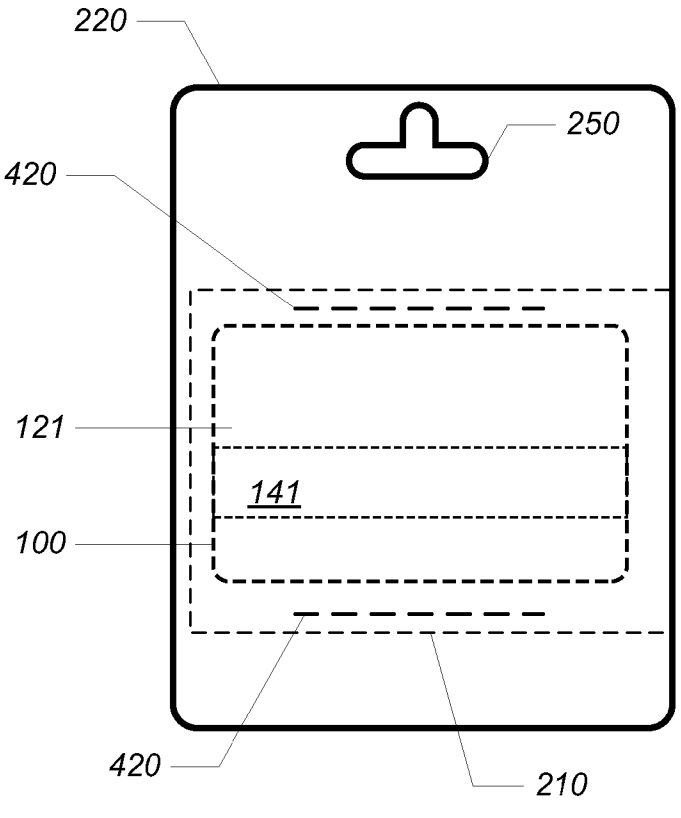
FIGS. 5 and 6 are respective plan back and front views of the preferred embodiment when completely folded together to package the card.

FIGS. 1-4 are plan views of a preferred embodiment of a financial transaction card carrier, which is formed (in the preferred embodiment) from a single piece or substrate of material. The carrier is completely laid flat and unfolded to show its various components, including (in FIGS. 3 and 4) a financial transaction card borne by the carrier. FIGS. 5 and 6 illustrate the carrier when folded up to contain the card, forming a package suitable for display or sale of the card in retail or similar contexts (FIG. 5) and activation at the sales terminal (FIG. 6).

Carrier 200 comprises three generally rectangular contiguous panels: internal panel 210, central panel 220, and side panel 230. The single panels illustrated do not exclude multiple-panel embodiments performing the same functions as described and claimed below. For example, unless specifically described and claimed otherwise, panels that adjoin each other by a fold line may be replaced with distinct panel-shaped pieces of material from different substrates instead. This could achieve the same result as the folded-up configuration illustrated in the preferred embodiment.

In the preferred embodiment illustrated, each panel is joined to its adjacent panel(s) by fold lines, such as fold line 411 which joins internal panel 210 and central panel 220. A similar fold line 412 joins the central panel 220 and side panel 230.

Figure 3:
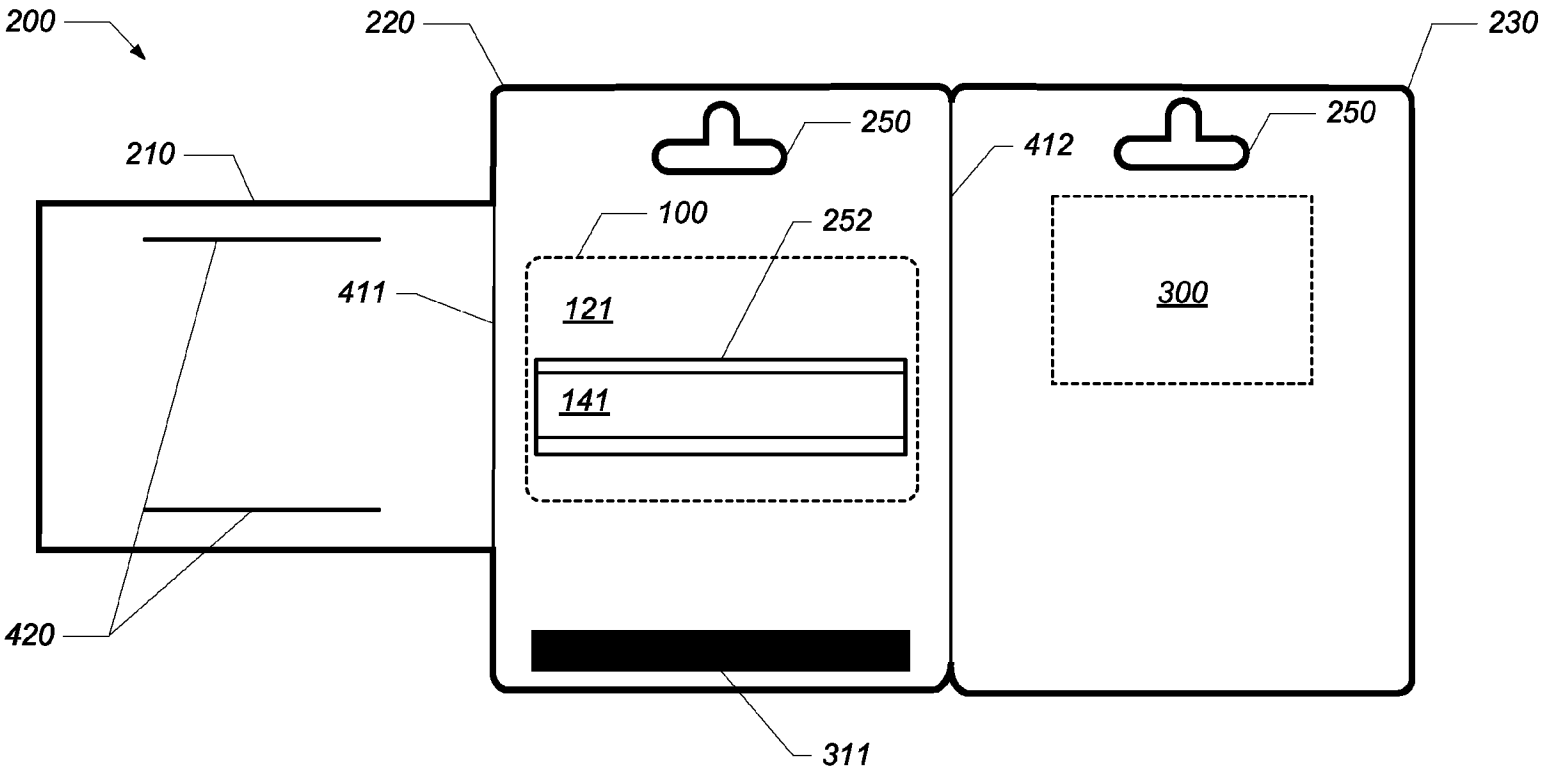
FIGS. 3 and 4 are respective views of the obverse and reverse sides illustrated in FIGS. 1 and 2, additionally showing the financial transaction card added to the card carrier.

As illustrated, each of the central and side panels may have an opening 250 or other feature to facilitate its display on a hook or rack or other fixture for storage, transportation, or display. It is also possible, but not required, to adhere or otherwise attach or include a flat object (such as a brochure or other printed material) to either panel. In FIG. 3, this "terms and conditions" insert is indicated as 300 and located on side panel 230.

On interior panel 210, cut lines 420 may be located (as in the embodiment of FIGS. 1-8) above and below the locations corresponding to the upper and lower edges of card 100 when it is attached to carrier 200. The location and angle of cut lines 420 is not critical except as specifically described and claimed in this application.

Figure 4:
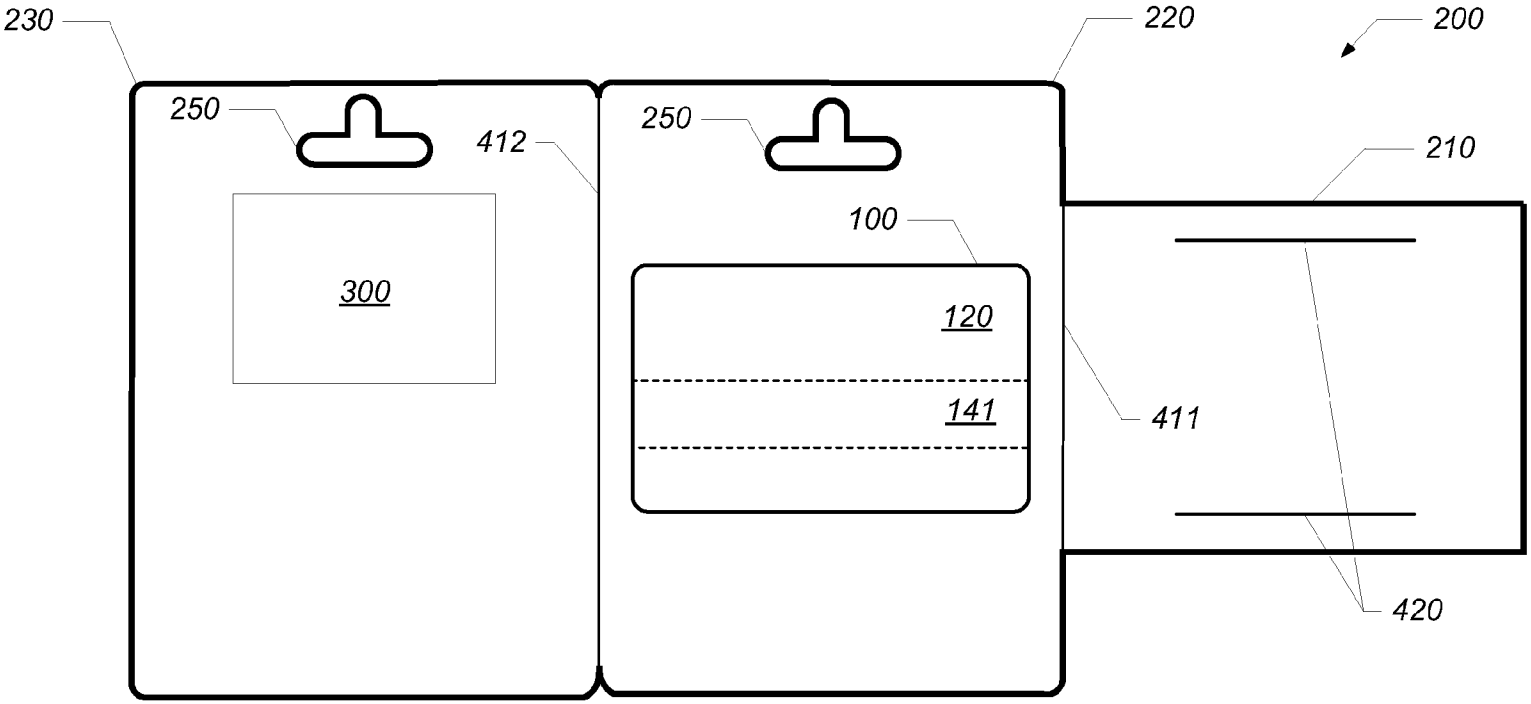
Figure 5:
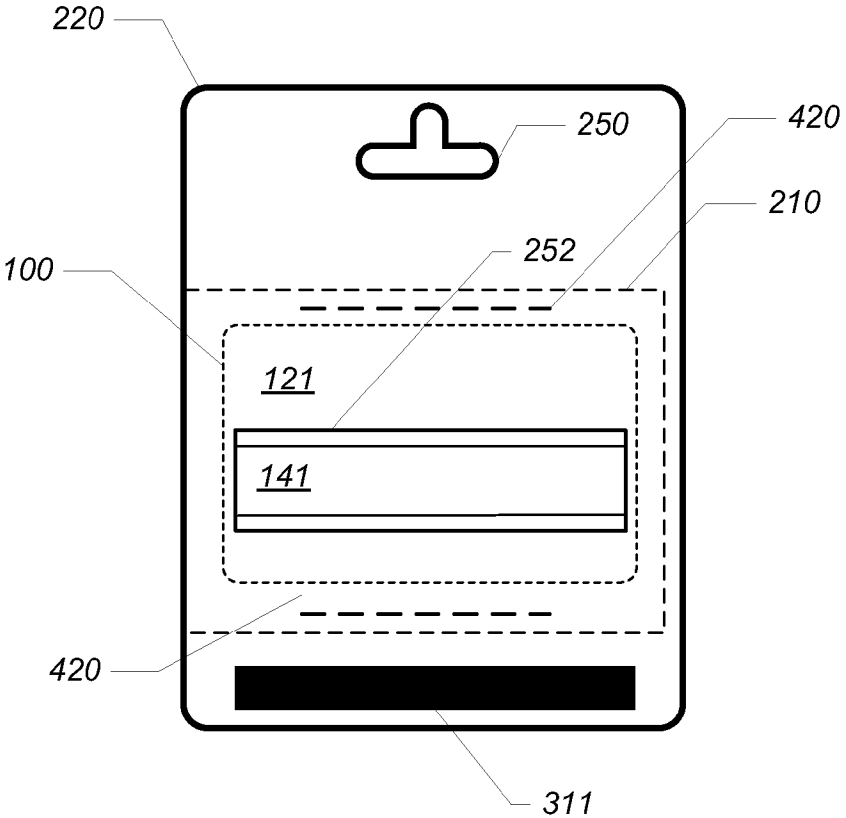

Turning briefly to FIGS. 3 and 4 in particular, card 100 is attached to a carrier 200 by any suitable technique, such as a line or dots of adhesive, i.e., the illustrated embodiment is a "two-piece" card/carrier combination in which the card is "tipped" or removably adhered (or the equivalent) to the carrier. While card 100 is illustrated in a landscape (horizontal) orientation, it could be turned by ninety degrees and oriented in a portrait (vertical) orientation.

Card 100, which lays back face down onto carrier 200, bears on its back face a barcode or other equivalent indicia 141, which is conventional and may encode various values as is well known in the art. A magnetic stripe (not illustrated) may also be provided on the card, although it is not accessible from outside the package. Such indicia are used to subsequently access the financial transaction account represented by card 100, typically at the point of sale, after the card has been removed from the package. Such access may be either to reduce the balance of the financial transaction account (i.e., use the account for purchases), to check the balance on the account, or to add to the account balance.

As described below, when carrier 200 is folded around card 100, interior panel 210 is first folded along line 411 over the front face 120 of card 100, and then the interior or back face of side panel 230 is folded along line 412 until side panel 230 lines up with front panel 220 to form a completed system in which card 100 is secured in a tamper-evident manner within a package, in this case folded carrier 200. The package and card together form a financial transaction system because card 100 may be activated, e.g. by magnetic stripe 311 on package 200.

Additional resistance to tampering or other improper access to the financial transaction account arises in the case that card 100 bears an optional embossed account number on its front face 120 (not shown). In that case, the thickness of the carrier material, present over the embossed number in three layers—interior, center, and side—helps prevent feeling or otherwise "reading" the embossed number from outside the folded carrier or other form of package. It should be noted, however, that a carrier, package, or system as defined by the claims will function identically for an embossed card as for a non-embossed card.

Thus, returning to FIGS. 1 and 2, the outer face (when fully folded up) of each of central panel 220 and side panel 230 are shown; interior panel 210 is not visible when carrier 200 is fully folded to surround card 100. All faces illustrated in FIG. 2 are interior and thus concealed when the package is fully assembled. The terms "front" and "back" are with reference to the package as a whole, although it should be clear that the customer-facing "front" of the package, as well as the oppositely-facing "back" of the package, are each the faces of their respective panels. In the preferred embodiment, such panels are visible in FIG. 1 but are not visible in FIG. 2, thus the "front" of the finished package is the face of side panel 230 visible in FIG. 1, while the "back" of the finished package is the face of central panel 220 in the same Figure.

The back of the financial transaction card 100 may face the back of the package so that aperture 252 (or other functionally equivalent means for making some or all of the back of the card visible) may be incorporated into the central panel 220 without interfering with the customer-facing appearance of the front of the package. Such an aperture could be any feature which allows viewing a selected portion of the card. Unless specifically described and claimed otherwise, an aperture may be any shape or size, and may be located in any position on any portion of the package (e.g., any location on one or more of the panels of a carrier, folded or otherwise assembled into a package).

As mentioned above, to assemble the combination of card and carrier, financial transaction card 100 is attached, adhered, affixed, or otherwise removably placed in the location illustrated, for example, by a pair of "dots" of releasable adhesive located on the upper two corners of card 100, but this is only an example. Financial transaction card carrier 200 is assembled into a package for card 100 by folding along each of the fold lines, and adhering certain portions together. Internal panel 210 is folded into the center of the carrier 200 over the card 100 at score line 411. Central and side panels 220, 230 are joined to each other in any convenient manner, such as adhering one or more edges together with a conventional adhesive. This manner of joining together the central and side panels is not a limitation on the scope of the invention, however.

The result is shown in FIGS. 5-6, with FIG. 6 showing the front of the financial transaction card package comprising carrier 200 in its fully folded position and FIG. 5 showing the back which provides access to the indicia for activation of the financial transaction card 100 as further described below.

Figure 7:
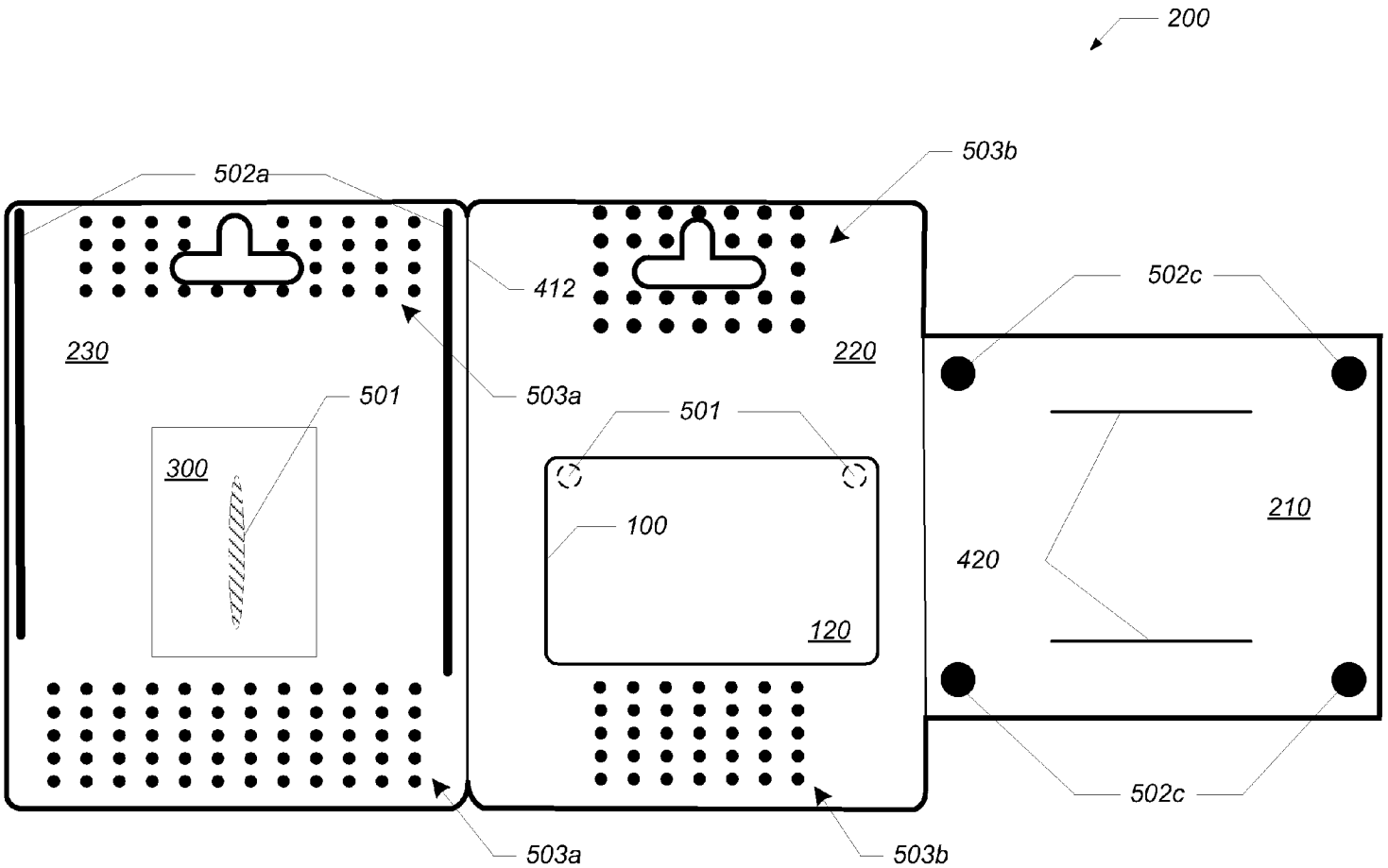
FIG. 7 is an alternative view of FIG. 4, illustrating locations for adhesives used in some embodiments.

Referring to FIG. 7, various adhesives are employed in the preferred embodiment. A pattern of cold adhesive dots 503*b* adjacent card 100 adheres internal panel 210 to central panel 220, as do dots of hot adhesive 502*c* on internal panel 210. Notably, these two applications of adhesive lie in regions between cuts 420 (but not contacting card 100) and the perimeter of internal panel 210. Thus, they provide additional security in the form of a physical barrier to accessing card 100 from either the top or bottom of the package. Additional dots of cold adhesive 503*a* on side panel 230 contribute to this barrier, as some of such adhesive joins side panel 230 to the opposite side of internal panel 220 (not shown in FIG. 7); that is, in this embodiment, internal panel 210 is first folded over card 100, followed by folding side panel 230 at fold line 412 to form the assembled package. (In this, as in other embodiments, a stack of separate panels could be assembled into a package for card 100 instead of the preferred embodiment of the one piece carrier 200 illustrated in the figures.)

Additional lines of hot melt adhesive 502*a* lie adjacent fold line 412 and thus join side panel 230 to central panel 220 and the opposite side of internal panel 210 (not shown in FIG. 7) depending on location. This forms similar barriers at the sides of the package, particularly because the lines of adhesive 502*a* extend downward (as depicted) far enough to lie laterally adjacent the location of card 100. It is preferred to put the lines of hot melt adhesive 502*a* on side panel 230 instead of central panel 220 to avoid the complexity associated with precision placement of such lines adjacent aperture 252 and card 100, neither of which should come in contact with hot melt adhesive.

Finally, removable adhesive 501 is used to attach terms and conditions 300 to side panel 230 and card 100 to central panel 220. Carrier 200 may then be folded together as described above, with the various hot melt and cold melt adhesives activated in conventional ways.

Figure 8:
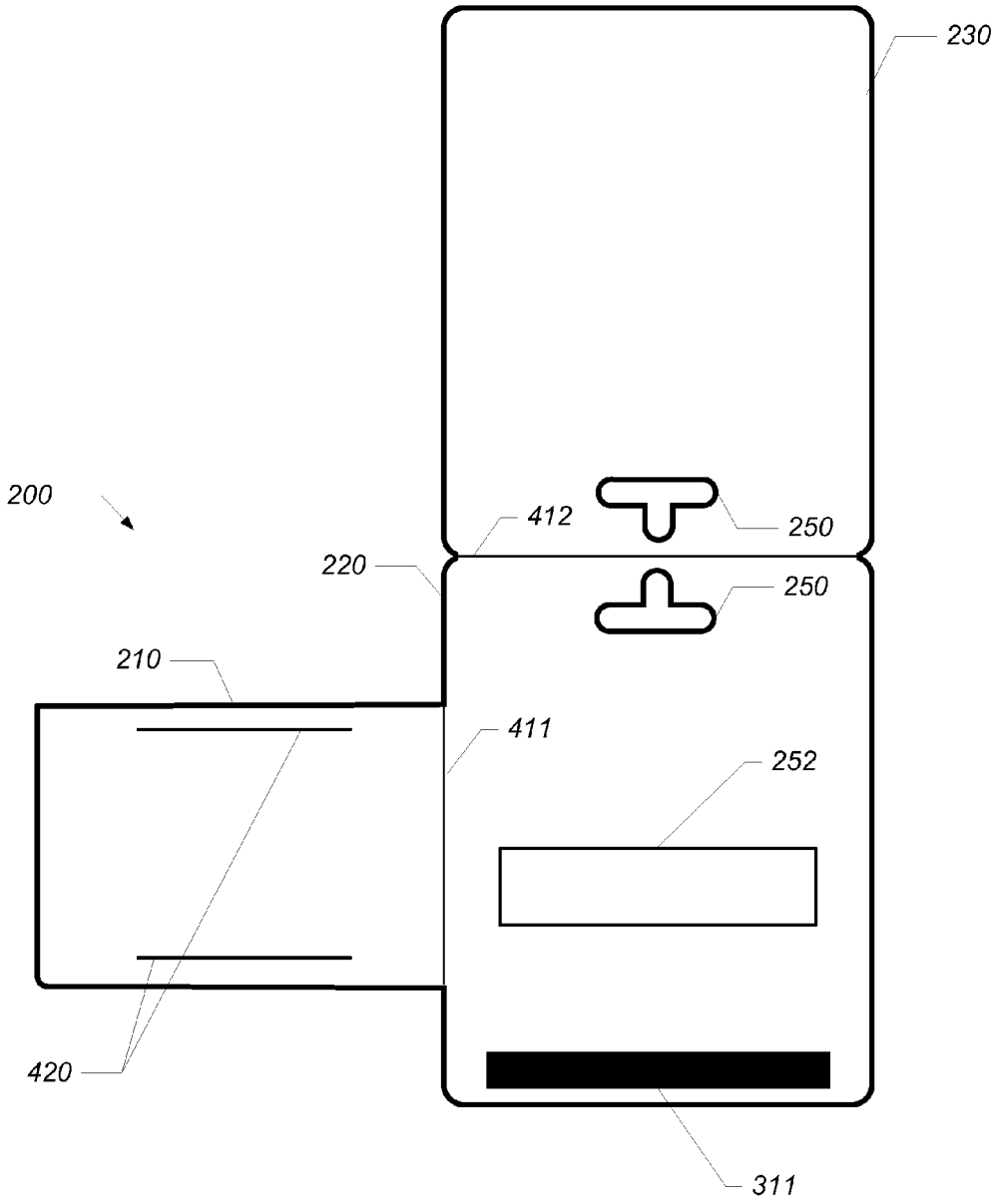
FIG. 8 is a view analogous to FIG. 1 of an alternative embodiment.
Figure 9:
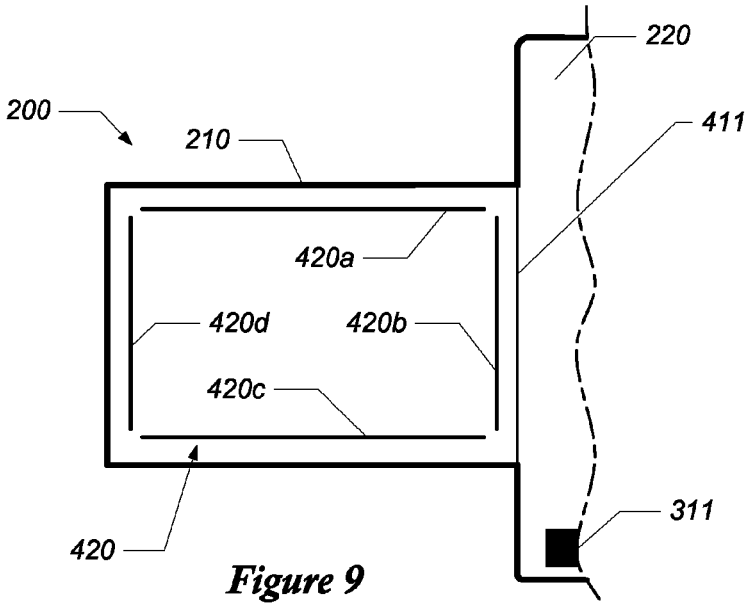
FIG. 9 is an alternative view of a portion of FIG. 1, schematically illustrating other locations for features of alternative embodiments.
Figure 10:
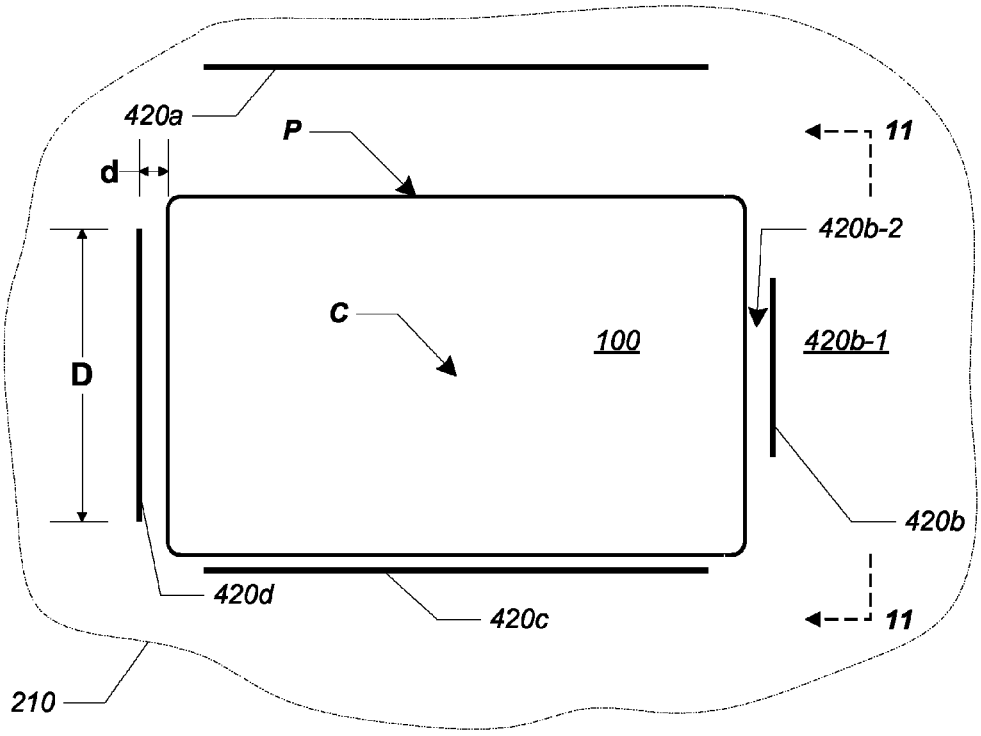
FIG. 10 is a schematic view of dimensional relationships between various features of alternative embodiments.

Turning to FIGS. 9-10, the two equally sized parallel, detached die cuts generally indicated as 420 in FIGS. 1-8 are a preferred embodiment of the more general case of as many as four die cuts indicated as 420*a-d*. More specific dimensional variations are schematically illustrated in FIG. 10. In particular, in cases in which more than one die cut is provided, each such die cut need not necessarily be the same length D (compare 420*b* to 420*c*). Nor are they necessarily located the same distance from card 100 (when carrier 200 is folded up) indicated as d (compare 420*a* to 420*d*). It is required that any die cut be located further from the center C of card 100 than the perimeter P of card 100 by a non-zero amount, preferably at least 1/32 inch, i.e., card 100 is not inserted into any die cut to secure it to the carrier 200. It is also preferred that each die cut be not more than approximately 1/4 inch from the perimeter of the card. The preferred length range for any die cut is 1.5 to 2.75 inch for a CR80 card, which equates to a range of approximately 70% to 80% of the dimension of the card (85.60 millimeter by 53.98 millimeter). Of course, these preferred dimensions may or may not vary for other formats of card (CR50, CR79, etc.), depending on factors such as the dimensions of the other portions of the package and the degree of security required.

Figure 11:
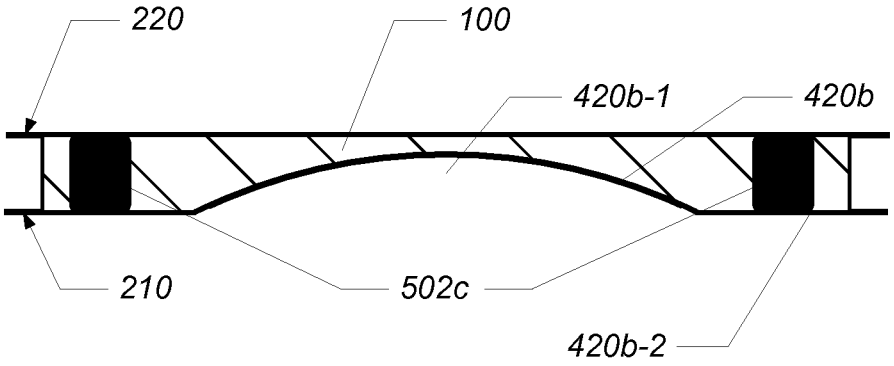
FIG. 11 is a schematic cross-sectional view taken along lines 11-11 of FIG. 10.

Thus, any such die cut is not in contact with the financial transaction card but restricts motion of the financial transaction card from inside the package to outside the package. This is illustrated in FIG. 11 which exaggerates for clarity the distance that the portion **420*b*-1 on the exterior side of die cut 420*b* may extend above the other side 420*b*-2 and thus contact the edge of card 100 to prevent movement of card 100. Such extension is helped by the adhesive 502*c* which cooperates with the materials to which it is applied to hold side 420*b*-1 in place against central panel 220. This allows side 420*b*-2 of the die cut to move sufficiently to create a raised or extended ridge, which prohibits (or at least restricts) motion of card 100**.

Also, a die cut, as opposed to an uncut portion of the internal panel, is more likely to exhibit evidence of tampering even if the attempt to remove card 100 is unsuccessful.

In the most preferred embodiment for conventional CR 80 format financial transaction card, internal panel 210 is approximately 3 27/32 inches in width (the horizontal dimension as shown in the Figures) and 2.6875 inches in height (the vertical dimension as shown in the Figures). Central panel 220 is approximately 5.25 inches in height and 3 31/32 inches in width (between fold lines 411 and 412). Side panel 230 is also approximately 5.25 inches in height and approximately 4.0 inches in width. It is useful for the height of the side panel to be slightly greater than that of the central panel, on the order of a millimeter. For these dimensions, a suitable aperture 252 is three inches wide and three-quarters of an inch in height.

Of course, these dimensions are not limitations on the scope of the invention, as they would depend upon the particular size of the piece of financial transaction card and other design factors, such as the amount of movement of the card within the package that is desirable or permitted before the financial transaction card carrier is opened. Changing other dimensions may be accomplished according to principles well within the ordinary level of skill in the art.

Turning specifically to FIGS. 5 and 6, to activate the account associated with financial transaction card 100, the assembled financial transaction card package is passed though a standard magnetic stripe reader, which reads data from magnetic stripe 311 for use in conventional activation techniques. For activation systems in which barcode 141 must be accessed, it is accessible through aperture 252. In any case, the account associated with the financial transaction card 100 is activated in whole or in part by magnetic stripe 311.

Figure 1:
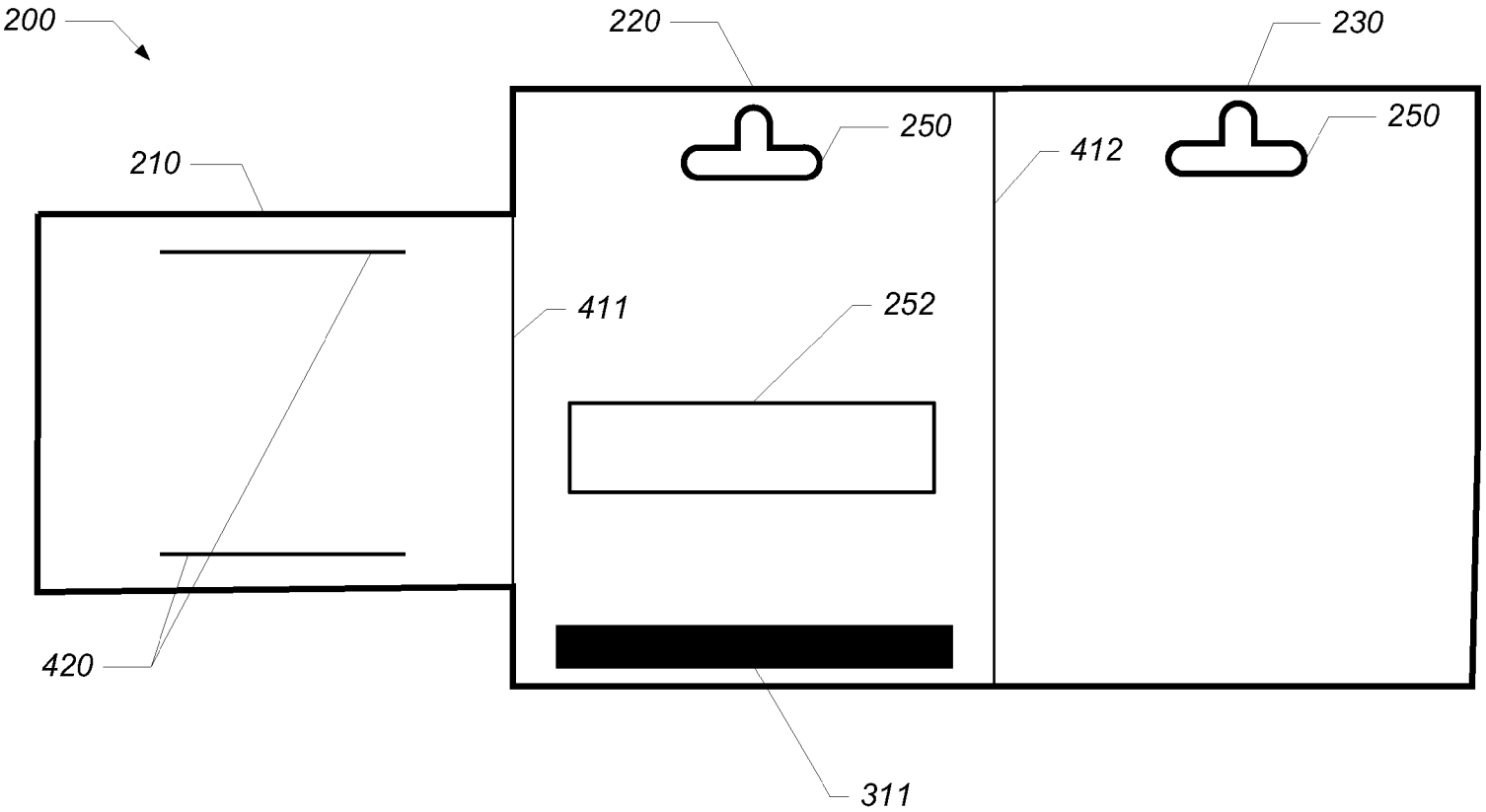
FIG. 1 is a plan view of an obverse side of a preferred embodiment of a financial transaction card carrier, completely laid flat and unfolded.
Figure 2:
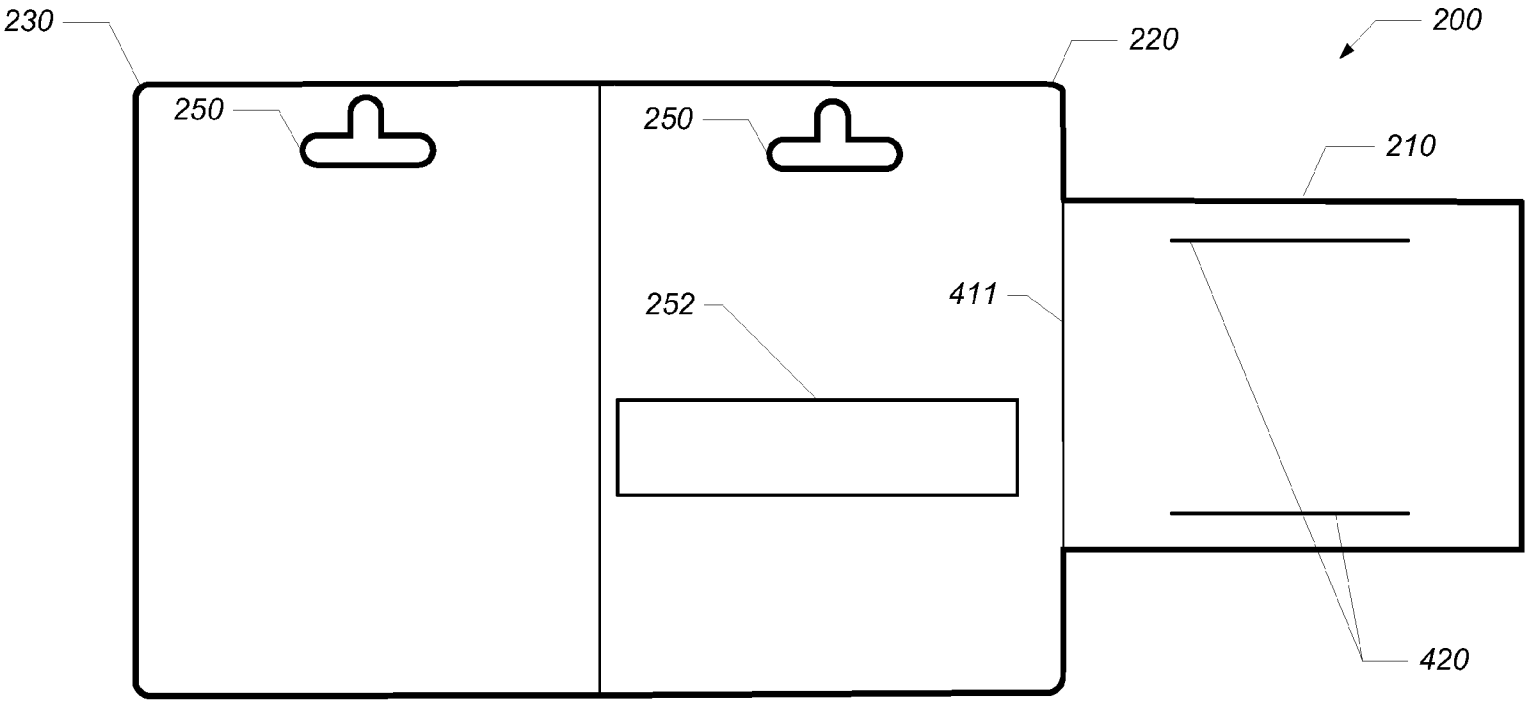
FIG. 2 is a plan view of a reverse face corresponding to FIG. 1.

FIG. 8 illustrates an alternative embodiment in a view analogous to that of FIG. 1. Other views of this alternative embodiment are not included but are analogous to those of FIGS. 2-7, particularly FIGS. 5 and 6 because the final assembly and operation of the same are essentially the same in this alternative embodiment. In this embodiment, the side panel 230 still adjoins central panel 220 at fold line 412, but not along the edge of central panel 220 that is directly opposite the edge at which internal panel 210 joins central panel 220 (i.e., fold line 411). This illustrates that the term "side" identifying side panel 230 is a label and not a structural or positional definition. The other side of card 100 is adjacent the junction of the central and side panels 220, 230 which are only adhered together.

While any heavy paper or cardstock is suitable for the invention provided it can be cut and folded as described above, the preferred board stock is known as SBS C1S (solid bleached sulfate, coated one side), having a weight in the range from approximately from 200 lb to 17 pt, with 12 pt the most preferred. As is known in the art, the selection of material influences the selection of adhesive, and vice versa, but any adhesive providing suitable bonding strength, peel test characteristics, and the like is suitable.

The preferred adhesives are water-based ("cold") extrusion adhesives, but hot-melt adhesives are also believed to be acceptable. In particular, as illustrated in FIG. 7, a combination of both types is used for various reasons known to those skilled in the art, such as ease of application (particularly in locations such as the edges of the central and side panels), and penetration into fibers (if present) of the carrier material for additional strength and thus resistance to tampering. Releasable adhesives are used to secure card 100 and terms and conditions 300 to carrier 200.

In this vein, it should be understood in the description above, and in the following claims, that the word "adhere" and its variants (adhesive, adhesion, etc.) are to read as broadly defining the concept of joining or forming an attachment between various separate parts, and thus such terms are intended to include other conventional and equivalent attachment mechanisms, such as adhesive tapes (whether single-sided or double-sided in their use of adhesive).

General Considerations

In all of the embodiments described above, as well as in other aspects of the invention as claimed even if not explicitly described above, the following features and functions may apply.

Card Usage and Function

In general, financial transaction cards are associated with transaction accounts to provide access to cash equivalent value which is usable in an existing transaction system. Credit cards, for example, provide access to the credit account of the card financial transaction card carrier. Stored value cards (also called debit cards, gift cards, pre-paid cards, cash cards and so on) provide access to the cash balance of an account associated with the card before use of the card is allowed. In general, such an account is usable in transactions between a user and a merchant or other third party through any suitable communication network, such as, for example, a telephone network, intranet, the global public Internet, a point of interaction device, online communications, off-line communications, wireless communications, etc. They may also be used in person at any point of sale (automated or not) that accepts them. The type of stored value card may be a gift card, loyalty card, credit or debit card, health card, phone card, pre-paid phone card, membership card, identification card, ring tone card, or any other type of card.

Card Features

Unless disclosed and claimed otherwise, a financial transaction card may include one or more account identifying elements. Suitable forms include magnetic stripe, radiofrequency identification (RFID), barcode, text (recognized by Optical Character Recognition (OCR)). The account identifying element is encoded with data, which includes a unique account number along with other data as required. More than one account identifying element may be included, and in any location.

If the card includes a magnetic stripe, that magnetic stripe may comprise a plastic film including tiny magnetic particles that can be magnetized in certain directions to record data on the card, which may be read by a card reader.

If the card includes a barcode, the barcode may comprise machine-readable data, which may be alpha-numeric. Barcode data includes black and white lines arranged to represent a series of numbers (e.g., a bar code comprising a Universal Product Code (UPC) has twelve digits) to a barcode scanner (printed account identifying elements).

Other current or future developed account identifying elements are also possible.

The card may include embossed or non-embossed features. An account identifying element(s) on the stored value card may be embossed (including at least one raised portion (e.g., letters, designs), or protuberance, etc.), or non-embossed.

Card Construction

Unless disclosed and claimed otherwise, the financial transaction card, while typically the size and shape of a conventional credit card (i.e., the CR80 format), may be any size and shape consistent with other relevant requirements. Possible materials include plastic, wood, and paper; but other materials (synthetic or natural) are possible. Specific examples include poly(vinylchoride) or PVC; polylactic acid or PLA; polycarbonate; polystyrene; paper; and cardstock. Cards may be manufactured individually (e.g., injection or other forms of molding) or cut from sheets. As known in the art, a completed card may be a monolithic substrate ("single core") bearing functional layers, or it may be the result of joining two or more subassemblies that have been individually manufactured and then joined together to form a completed (or partially completed) card ("split core").

Indicia

Unless disclosed and claimed otherwise, an indicia borne on a card or carrier may be a magnetic stripe (conforming to international standards or otherwise) capable of being "read" or otherwise interpreted into an alphanumeric string of characters; a barcode (one dimensional or two dimensional), printed text or numbers, embossed text or numbers, a RFID tag, biometric feature, or any text or graphic logo imprinted or otherwise borne on the card. The exact quantity, location, data format, and function of any indicia is limited only by the claims. Any indicia may explicitly appear as an alphanumeric sequence (e.g., account financial transaction card carrier name or account number) or may represent such a sequence (e.g., a barcode that may or may not be accompanied by a printed representation of some or all of the data encoded into the barcode). Multiple instances of indicia may be included (e.g., a single indicia repeated at a different location—such as an account number that is both embossed into the front of the card and printed on the back of the card; or two indicia which each individually is insufficient to uniquely identify a card or account but which do so when taken together with each other or with other information). Common indicia include one or more account numbers; card serial numbers; activation indicia; manufacturing information; packaging information; personal data (e.g., the "personal identification number" or PIN, or other "personal" data such as (for example) the customer verification value or "CVV" used in some transaction systems).

Card Manufacture

Unless specifically described and claimed otherwise, a card or carrier may be manufactured by conventional techniques or any other techniques that produce the same result. Conventional manufacturing steps including pretreatment, UV (or equivalent) printing, press polishing, lamination, die cutting (or punching), and the like, all having the meanings and scope known in the art. Similarly, the manufacturing process may be sheet-fed or web-fed in nature, such terms and techniques again having the meanings and scope known in the art.

Graphics

One or more graphics may be included on a card or carrier or package. Examples include pictorial information of any kind (typically, but not exclusively, on the front or customer-facing side of the card or carrier or both). Graphics may be combined (or coordinated) with indicia in any convenient manner. The preferred method of providing graphics is printing with UV-cured inks, as is well known in the art.

Carrier Construction

The carrier includes one or more panels, as shown in the figures, and each panel may be made of more than one piece of material. Preferably, the carrier is made of paper or cardstock; however other materials, such as polymeric materials (similar to if not the same as those from which cards themselves are manufactured) or synthetic paper, are also suitable. The material may be laminated on one or more sides with a transparent material capable of receiving printed material. The laminating material may be a plastic material such as polyvinyl chloride (PVC), polyethylene terephthalate (PET), polyethylene terephthalate glycol (PETG), or acrylonitrile butadiene styrene (ABS). The laminating material may be bonded or applied to the sheet of material in a conventional matter. The laminating layer provides the carrier with a certain degree of rigidity, for improved handling during manufacture and afterward. It also helps protect any graphics or other information which may be present.

Card and/or Carrier Indicia

While not shown in the figures, the front and/or rear of the systems (card and/or carrier) may be printed with information to promote the card when it is displayed at a retail establishment location, such as the name or logo of the retail establishment, a predetermined amount or value of the card, instructions for use, various commercial text (e.g., legal text) and so forth.

Numbers and Types of Cards

Unless specifically described and claimed otherwise, a card and carrier system may include single or multiple cards associated with a given carrier. When present, multiple cards may be identical or coordinated with each other, e.g., two or more cards in a single package may be linked to or otherwise correlated with a single financial account or multiple financial accounts, even if the cards are not otherwise identical to each other.

The following claims may use the language "first," "second," "third," and so on to specifically distinguish between various elements that are otherwise similarly named, such as fold lines, edges, and the like. These terms are not intended to imply any order of importance or time sequence in the manufacturing or use of the invention, unless other claim language specifically does so.

In the context of attachment of one piece to another, it should be understood that a "line" of attachment may be a region of attachment which is longer than it is wide, the "line" being the longer dimension. It is not necessarily so that the region is continuous, i.e., either a line of adhesive or a line of "dots" of adhesive may form an attachment line, as may a perforated line. Nor is it necessary that the pieces first be separate pieces subsequently brought together. That is, an "attachment" line may be a fold line formed in a single piece of material to create two adjoining panels or portions of a panel.

It is also clear that the appearance and manner in which the financial transaction card functions are not limitations on the scope of the invention, except as described above and in the following claims.

We claim:

1. A financial transaction package, comprising:

a) an internal panel attached to a central panel, and a side panel attached to the central panel such that the internal panel lies between the central panel and the side panel;

b) the internal panel having a perimeter, at least two cuts in the internal panel, and adhesive between each cut and the perimeter to adhere the internal panel to the central panel; and c) at least one financial transaction card between the internal panel and the central panel positioned between but not inserted into either of the two parallel cuts in the internal panel, in which the card has a center and a card perimeter and each of the two parallel cuts is at least 1/32 inch farther from the center of the card than the perimeter of the card, in which the adhesive holds only a first portion of the internal panel against the central panel, and thereby a second portion of the internal panel, opposite either of the two parallel cuts from the first portion of the internal panel, restricts motion of the card from inside the package to outside the package prior to opening the package.

2. The package of claim 1, in which at least one of the internal panel and the side panel is attached to the central panel at a fold line.

3. The package of claim 1, in which at least one of the internal panel and the side panel is attached to the central panel at an adhesion line.

4. The package of claim 1, in which the internal panel has two horizontal cuts.

5. The package of claim 1, in which the internal panel has two vertical cuts.

6. The package of claim 1, in which the internal panel has four cuts, one on each side of a rectangular transaction card.

7. The package of claim 1, in which each of the two parallel cuts is parallel to an edge of the card.

* * * * *